US006914499B2

(12) United States Patent
Kitaichi et al.

(10) Patent No.: US 6,914,499 B2
(45) Date of Patent: Jul. 5, 2005

(54) CONDUCTIVE COVER FOR DIELECTRIC FILTER, DIELECTRIC FILTER, DIELECTRIC DUPLEXER, AND COMMUNICATION APPARATUS

(75) Inventors: Yukihiro Kitaichi, Nagaokakyo (JP); Takashi Maruyama, Fukui-ken (JP); Yasuo Yamada, Fukui-ken (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 10/705,956

(22) Filed: Nov. 13, 2003

(65) Prior Publication Data

US 2004/0119563 A1 Jun. 24, 2004

(30) Foreign Application Priority Data

Dec. 19, 2002 (JP) ..... 2002-368606

(51) Int. Cl.[7] ..... H01P 1/202
(52) U.S. Cl. ..... 333/202; 333/134; 333/206
(58) Field of Search ..... 333/134, 202, 333/206, 207

(56) References Cited

U.S. PATENT DOCUMENTS 4,906,955 A * 3/1990 Yorita et al. ..... 333/207
5,250,916 A * 10/1993 Zakman ..... 333/206
5,374,910 A * 12/1994 Yamagata ..... 333/206
5,745,018 A * 4/1998 Vangala ..... 333/202
6,400,239 B1 * 6/2002 Chun et al. ..... 333/206

FOREIGN PATENT DOCUMENTS

| | | |
|---|---|---|
| JP | 08-097610 | 4/1996 |
| JP | 09-167902 | 6/1997 |
| JP | 2002-299907 | 10/2002 |

* cited by examiner

*Primary Examiner*—Seungsook Ham
(74) *Attorney, Agent, or Firm*—Dickstein, Shapiro, Morin & Oshinsky, LLP.

(57) ABSTRACT

A dielectric filter includes a conductive cover formed by bending a metal plate and forming at least one inwardly projecting portion at a predetermined position along the bent portion. The inner surface of the at least one inwardly projecting portion abuts on an open circuit surface or edge of a dielectric block. Thus, the distance between the open circuit surface of the filter and the conductive cover is reliably maintained and unnecessary coupling between adjacent resonators is prevented.

20 Claims, 5 Drawing Sheets

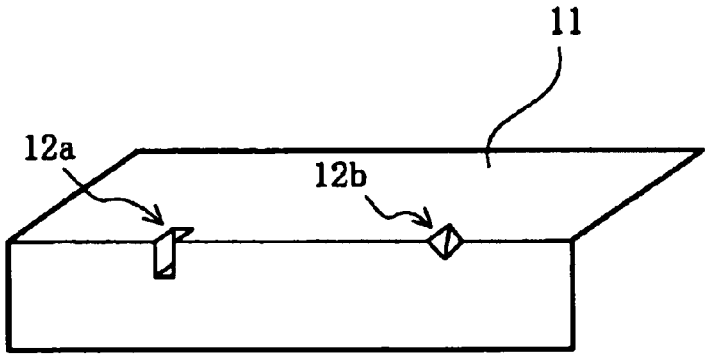
FIG. 1A
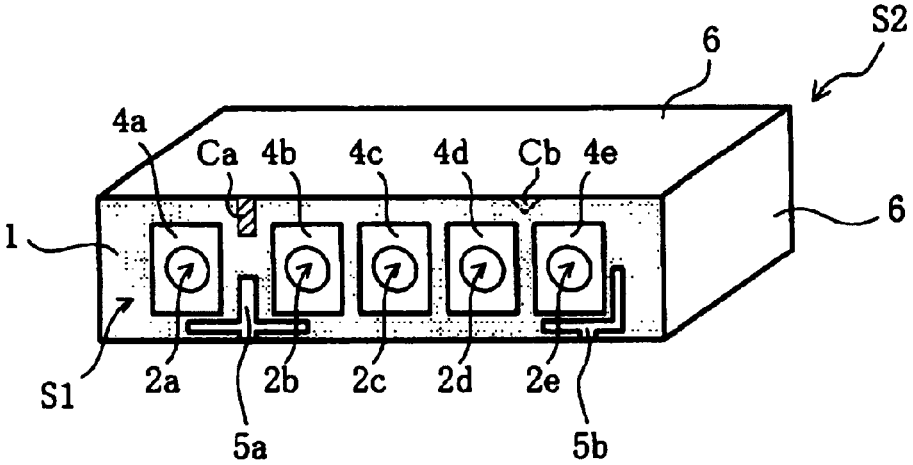
FIG. 1B
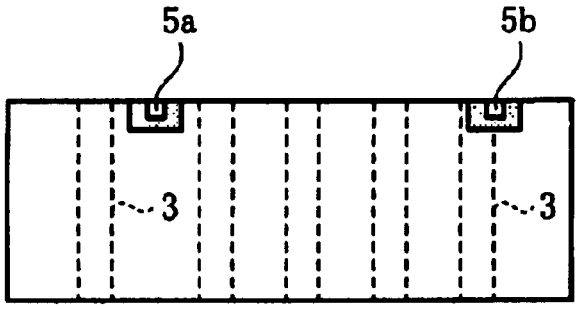

CONDUCTIVE COVER FOR DIELECTRIC FILTER, DIELECTRIC FILTER, DIELECTRIC DUPLEXER, AND COMMUNICATION APPARATUS

BACKGROUND OF THE INVENTION

1. Field of the Invention

The present invention relates to a dielectric filter provided with a dielectric block and a conductive cover, a dielectric duplexer, and a communication apparatus including the dielectric filter and the dielectric duplexer.

2. Description of the Related Art

A dielectric filter which has a substantially-rectangular-parallelepiped dielectric block having resonator holes arranged in parallel and internal conductors formed on internal surfaces of the resonator holes, and which has external conductors formed on the filter has been used as a microwave filter.

In the dielectric filter of the above type, in order to eliminate a problem of unnecessary radiation of electromagnetic waves from an open circuit surface of the dielectric filter to the exterior, or unnecessary coupling with the exterior, a conductive cover is provided to cover the open circuit surface of the dielectric block (e.g., Japanese Unexamined Patent Application Publication No. 9-167902).

The conductive cover (of the related art) of the dielectric filter of the above type is formed by simply bending a metal plate at a substantially right angle in one position.

Accordingly, there is a possibility that the conductive cover may be deformed by some external force while the dielectric filter is produced or when the finished dielectric filter is mounted on a circuit board in an electronic device, or after the mounting step. If the conductive cover is shaped to have an acute bending angle, the distance between an open circuit surface of the dielectric block and the conductive cover at a position where they face each other changes, thus changing the electrical characteristics of the filter. Also, if the conductive cover has an obtuse bending angle, the distance between the open circuit surface of the dielectric block and the conductive cover in a position where they face each other changes, so that, in general, the electromagnetic shielding effect decreases.

In the dielectric filter provided with the conductive cover of the related art, coupling electrodes provided on the open circuit surface of the dielectric filter are used to establish coupling between resonators, or coupling between a predetermined resonator and the exterior.

In this case, since two adjacent resonators are easily coupled, the distance between two resonators not to be coupled must be increased. This is part of the reason why reduction in the size of the dielectric filter size is prevented.

SUMMARY OF THE INVENTION

It is an object of the present invention to provide a dielectric filter and a dielectric duplexer in which unnecessary coupling between predetermined resonators is prevented when a conductive cover is provided, and a communication apparatus including the dielectric filter and duplexer.

According to an aspect of the present invention, a dielectric filter is provided which includes: a substantially-rectangular-parallelepiped dielectric block having therein resonator holes extending between a first surface of the dielectric block and a second surface opposite to the first surface, the resonator holes being arranged in parallel and having internal conductors formed on the internal surfaces of the resonator holes; external conductors formed on surfaces of the dielectric block, the first surface of the dielectric block being used as an open circuit surface; and a conductive cover for covering the open circuit surface of the dielectric block. The conductive cover is bent so as to have one part of a surface of the conductive cover in contact with one of the external conductors on the dielectric block and parallel to both the extending direction and arrangement direction of the resonator holes, and another part of the surface of the conductive cover parallel to the open circuit surface of the dielectric block. The conductive cover includes inwardly projecting shaped portions at predetermined positions along the bent portion.

Preferably, the shaped portions are in contact with the open circuit surface of the dielectric block between two predetermined adjacent resonator holes among the resonator holes.

According to another aspect of the present invention, a dielectric duplexer is provided wherein, in the dielectric filter, the resonator holes form a transmitting filter and a receiving filter in the dielectric block, and the shaped portions are disposed between the transmitting filter and the receiving filter.

According to another aspect of the present invention, a communication apparatus including the dielectric filter or the dielectric duplexer is provided.

According to the present invention, a conductive cover covering an open circuit surface of a dielectric block includes inwardly projecting shaped portions in predetermined positions along a bent portion of the conductive cover, whereby the strength of the bent portion is increased. Also, by positioning the shaped portions of the conductive cover between open portions of two adjacent resonators, unnecessary coupling between the two resonators is suppressed.

According to the present invention, the shaped portions each have a shape in contact with the open circuit surface of the dielectric filter, and the shaped portions abut on the open circuit surface of the dielectric filter between two adjacent resonator holes among a plurality of resonator holes. Thus, it is ensured that unnecessary coupling between two adjacent resonators is suppressed.

According to the present invention, in a dielectric duplexer in which a plurality of resonator holes constitute a transmitting filter and a receiving filter in a single dielectric block, shaped portions of a conductive cover are provided between the transmitting filter and the receiving filter. This can prevent unnecessary coupling between the transmitting filter and the receiving filter. Thus, the entirety of the dielectric duplexer has a small size caused by closely disposing the transmitting filter and the receiving filter.

BRIEF DESCRIPTION OF THE DRAWINGS

FIGS. 1A and 1B are an exploded perspective view and bottom view showing a dielectric filter according to a first embodiment of the present invention;

DESCRIPTION OF THE PREFERRED EMBODIMENTS

Figure 2A:
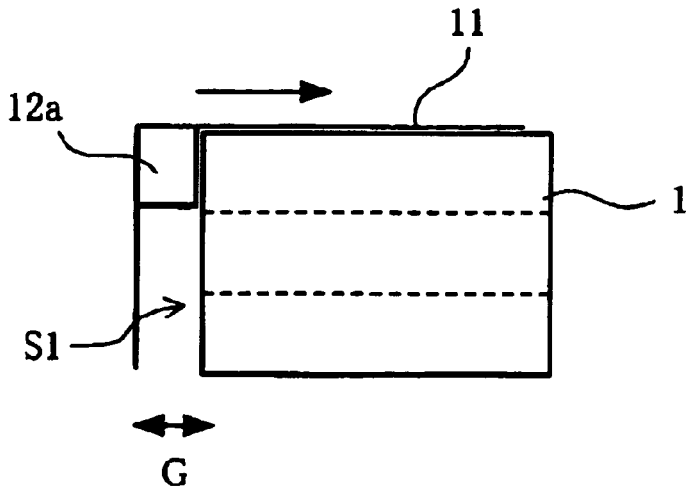
FIGS. 2A and 2B are sectional view showing the main part of the dielectric filter shown in FIGS. 1A and 1B.

The structure of a dielectric filter according to a first embodiment of the present invention is described below with reference to FIGS. 1A to 2B.

FIG. 1A is an exploded perspective view of the dielectric filter, and FIG. 1B is a bottom view of the dielectric filter. The dielectric block 1 is preferably a substantially rectangular parallelepiped. Between a first surface S1 (hereinafter also referred to as the "open circuit surface") of the dielectric block 1 and a second surface S2 opposite thereto, five resonator holes 2*a* to 2*e* are arranged in parallel. On the internal surfaces of the resonator holes 2*a* to 2*e*, internal conductors 3 are formed. Among the external surfaces (six surfaces) of the dielectric block 1, preferably five surfaces other than the open circuit surface S1 have external conductors 6 formed thereon. The internal conductors 3 on the internal surfaces of the resonator holes 2*a* to 2*e* are conductively coupled with the external conductors 6 on the second surface S2 of the dielectric block 1. In other words, the second surface S2 is used as a short-circuiting surface. The first surface S1 of the dielectric block 1 is open, and on this surface, coupling electrodes 4*a* to 4*e* conductively coupled with the internal conductors 3 on the internal surfaces of the resonator holes 2*a* to 2*e* are formed. Also, external coupling electrodes 5*a* and 5*b* are formed extending from the open circuit surface S1 to the bottom surface, as shown in FIGS. 1A and 1B.

The external coupling electrode 5*a* is capacitively coupled to two resonators formed by the resonator holes 2*a* and 2*b* by capacitors formed by the external coupling electrode 5*a* and the coupling electrodes 4*a* and 4*b*. Similarly, the external coupling electrode 5*b* is capacitively coupled to a resonator formed by the resonator hole 2*e* by a capacitor formed by the external coupling electrode 5*b* and the coupling electrode 4*e*. Also, regarding four resonators formed by the resonator holes 2*b*, 2*c*, 2*d*, and 2*e*, each capacitor of capacitors formed by the coupling electrodes 4*b* and 4*c*, a capacitor formed by the coupling electrodes 4*c* and 4*d*, and a capacitor formed by the coupling electrodes 4*d* and 4*e* establishes capacitive coupling between two adjacent resonators.

Among the five resonators, the resonator formed by the resonator hole 2*a* operates as a trap filter formed by a 1-stage resonator connected between the external coupling electrode 5*a* and the ground. The four resonators formed by the resonator holes 2*b* to 2*e* operate as a 4-stage-resonator bandpass filter in which adjacent resonators are capacitively coupled to each other.

FIG. 1A shows a conductive cover 11. The conductive cover 11 is formed by bending a metal plate at preferably a substantially right angle at a predetermined position, and forming inwardly projecting shaped portions 12*a* and 12*b* at predetermined positions along the bent portion. The shaped portions 12*a* and 12*b* are depressions when viewed from the outside of the conductive cover 11, while they are projections when viewed from the inside of the dielectric block 1. The conductive cover 11 is placed on a side surface (the top surface in FIG. 1A) of the dielectric block 1 so as to have a predetermined distance with respect to the open circuit surface S1 of the dielectric block 1.

Figure 2B:
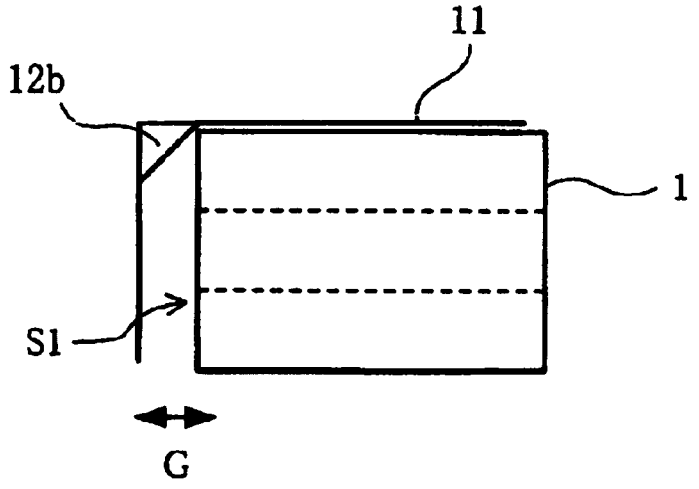

FIGS. 2A and 2B are cross-sectional views showing a state in which the conductive cover 11 is placed on the dielectric block 1. FIG. 2A is a cross-sectional view of the state in a plane passing through the shaped portion 12*a*, and FIG. 2B is a cross-sectional view of the state in a place passing through the shaped portion 12*b*. In FIGS. 2A and 2B, only the conductive cover 11 is shown as a cross-section. The conductive cover 11 is placed on the dielectric block 1 so that the shaped portion 12*a* of the conductive cover 11 abuts on the open circuit surface S1 of the dielectric block 1. Accordingly, the distance G between the open circuit surface S1 of the dielectric block 1 and an opposing surface of the conductive cover 11 is determined by each of the depths (amount of projection with respect to the dielectric block 1) of the shaped portions 12*a* and 12*b*.

As described above, by providing the shaped portions 12*a* and 12*b* in the bent portion of the conductive cover 11, the strength (rigidity) of the bent portion of the conductive cover 11 is increased. As a result, while the dielectric filter is produced or when the finished dielectric filter is mounted on a circuit board of an electronic device, or after the mounting step, the conductive cover 11 can be prevented from being deformed. This makes it possible to maintain the stability of the electrical characteristics required for a dielectric filter, while ensuring suitable electromagnetic shielding.

The shaped portion 12*a*, which is one of the two shaped portions provided on the conductive cover 11, is rectangular in cross-section and is in contact with a position Ca (FIG. 1A) on the open circuit surface S1 of the dielectric block 1. This results in reduced coupling (capacitive coupling generated by the capacitors formed by the coupling electrodes 2*a* and 2*b*) between the two resonators formed by the resonator holes 2*a* and 2*b*. Also, the shaped portion 12*b*, which is a right-angled triangle in section, is in contact with part of the edge (denoted by Cb in FIG. 1A) of the dielectric block 1. Thus, the shaped portion 12*b* does not prevent coupling between the two resonators formed by the resonator holes 2*d* and 2*e*. This eliminates unnecessary coupling between the above trap resonator and an initial or end stage resonator of the bandpass filter, so that the trap filter and the bandpass filter can exhibit their intended characteristics.

Next, a dielectric duplexer according to a second embodiment of the present invention is described below with reference to FIGS. 3A to 4.

Figure 3A:
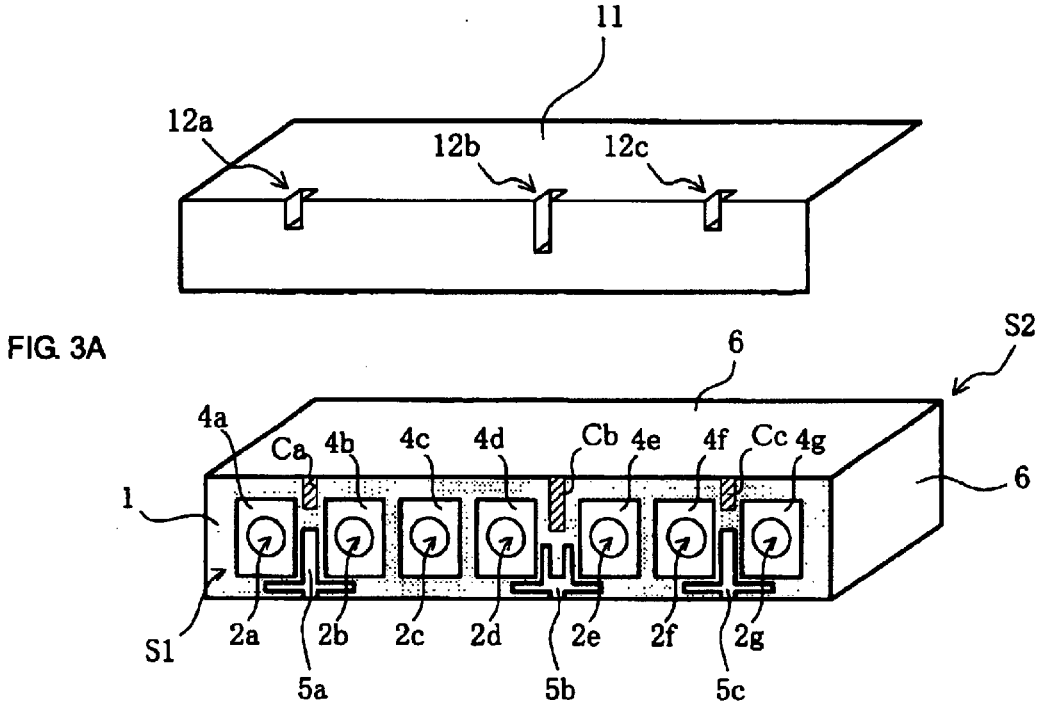
FIGS. 3A and 3B are an exploded perspective view and bottom view showing a dielectric duplexer according to a second embodiment of the present invention.
Figure 3B:
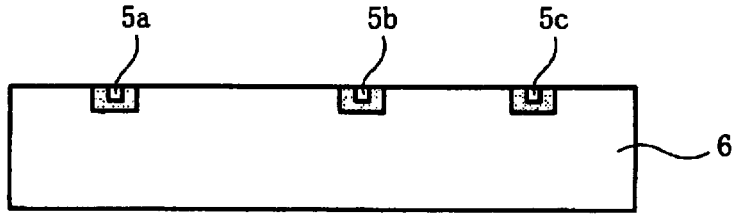

FIG. 3A is an exploded perspective view of the dielectric duplexer, and FIG. 3B is a bottom view of the dielectric duplexer. The dielectric block 1, preferably a substantially rectangular parallelepiped, is shown with seven resonator holes 2*a* to 2*g* extending between a first surface (hereinafter also referred to as an "open circuit surface") S1 and a second surface S2 opposite thereto. The resonator holes 2*a* to 2*g* have internal conductors formed on their internal surfaces. Among the external surfaces (six surfaces) of the dielectric block 1, preferably five surfaces other than an open circuit surface S1 have external conductors 6 formed thereon. The internal conductors on the internal surfaces of the resonator holes 2*a* to 2*g* are conductively coupled with the external conductors 6 on the second surface S2 of the dielectric block 1. In other words, the second surface S2 is used as short-circuiting surface. The first surface S1 of the dielectric block 1 is open, and on the open circuit surface S1, coupling electrodes 4*a* to 4*g* are formed which are conductively coupled with the internal conductors on the internal surfaces of the resonator holes 2*a* to 2*g*. Also, external coupling electrodes 5*a*, 5*b*, and 5*c* are formed from the open circuit surface S1 to the bottom surface shown in FIGS. 3A and 3B. The external coupling electrode 5*a* is capacitively coupled to two resonators formed by the resonator holes 2*a* and 2*b* by a capacitor formed by the coupling electrodes 4*a* and 4*b*. The external coupling electrode 5*c* is capacitively coupled to resonators formed by the resonator holes 2*f* and 2*g* by a capacitor formed by the coupling electrodes 4*f* and 4*g*. Similarly, the external coupling electrode 5*b* is capacitively coupled to resonators formed by the resonator holes 2*d* and 2*e* by a capacitor formed by the coupling electrodes 4*d* and 4*e*. Regarding the three resonators formed by the resonator holes 2*b*, 2*c*, and 2*d*, each of a capacitor formed by the coupling electrodes 4*b* and 4*c*, and a capacitor formed by the coupling electrodes 4*c* and 4*d* establishes capacitive coupling between two adjacent resonators. Similarly, two resonators formed by the resonator holes 2*e* and 2*f* are capacitively coupled to each other by a capacitor formed by the coupling electrodes 4*e* and 4*f*.

Among the seven resonators, the resonator formed by the resonator hole 2*a* operates as a trap filter formed by a resonator formed by a 1-stage resonator connected between the external coupling electrode 5*a* and the ground. Similarly, the resonator formed by the resonator hole 2*g* operates as a trap filter formed by a 1-stage resonator connected between the external coupling electrode 5*c* and the ground. The three resonators formed by the resonator holes 2*b* to 2*d* operate as a 3-stage-resonator bandpass filter in which adjacent resonators are capacitively coupled to each other. Similarly, the two resonators formed by the resonator holes 2*e* and 2*f* operate as a 2-stage-resonator bandpass filter in which adjacent resonators are capacitively coupled to each other.

Figure 5:
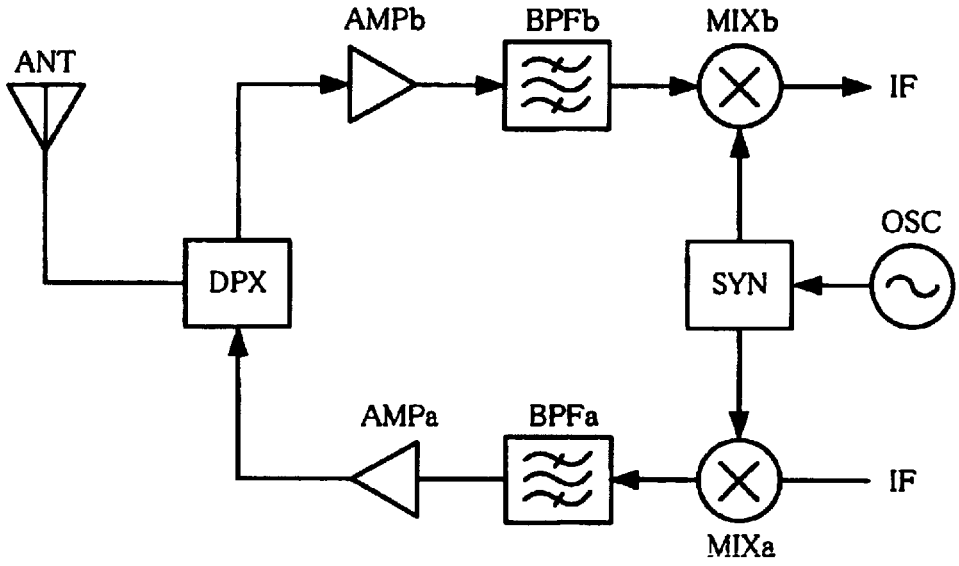
FIG. 5 is a block diagram showing a communication apparatus according to a third embodiment of the present invention.

The external coupling electrode 5*a* is used as a receiving signal output terminal (corresponding to RX in FIG. 5), the external coupling electrode 5*c* is used as a transmitting signal input terminal (corresponding to TX in FIG. 5), and the external coupling electrode 5B is used as an antenna terminal (corresponding to ANT in FIG. 5). Accordingly, the bandpass filter formed by the resonator holes 2*b*, 2*c*, and 2*d* operates as a receiving filter that allows a receiving band to pass through it. A trap filter formed by the resonator hole 2*a* attenuates a transmitting band. Also, the bandpass filter formed by the resonator holes 2*e* and 2*f* operates as a transmitting filter that allows a transmitting band to pass through it. A trap filter formed by the resonator hole 2*g* operates as a trap resonator for attenuating a received signal frequency band.

Shaped portions 12*a*, 12*b*, and 12*c* provided on the conductive cover 11 abut on positions Ca, Cb, and Cc on the open circuit surface S1 of the dielectric block 1. The shaped portion 12*a* prevents unnecessary coupling between the two resonators formed by the resonator holes 2*a* and 2*b*. The shaped portion 12*b* prevents unnecessary coupling between the two resonators formed by the resonator holes 2*d* and 2*e*. The shaped portion 12*c* prevents unnecessary coupling between the two resonators formed by the resonator holes 2*f* and 2*g*. As described above, unnecessary coupling between the bandpass filter and the trap filter is prevented and unnecessary coupling between the transmitting filter and the receiving filter is also prevented.

Figure 4:
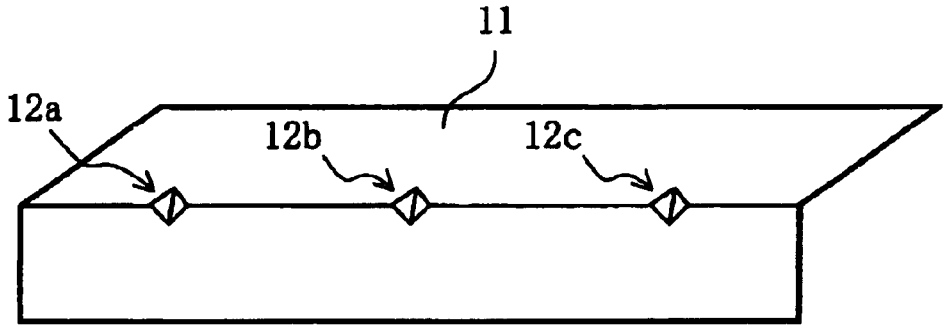
FIG. 4 is a perspective view showing a conductive cover whose shape is different from that of the dielectric filter shown in FIGS. 1A and 1B.

Although in FIGS. 3A and 3B all the shaped portions 12*a*, 12*b*, and 12*c* provided on the conductive cover 11 are rectangular in cross-section, as FIG. 4 shows, they may be formed triangular in cross-section. In addition, although all the resonator holes 2*a* to 2*e* are shown as straight holes having internal diameters, they may also be formed as so-called "step holes" which each have different internal diameters at an open end and short-circuiting end thereof. Alternatively, the straight holes and the step holes may be combined.

Next, a communication apparatus according to a third embodiment of the present invention is described below with reference to FIG. 5.

The communication apparatus preferably includes a transmitting/receiving antenna ANT, a duplexer DPX, bandpass filters BPFa and BPFb, amplifying circuits AMPa and AMPb, mixers MIXa and MIXb, an oscillator OSC, and a frequency synthesizer SYN.

The mixer MIXa mixes a transmitting intermediate frequency IF and a signal output from the frequency synthesizer SYN. The bandpass filter BPFa only allows a transmitting frequency band in a mixed signal output from the mixer MIXa to pass through it. The amplifying circuit AMPa performs power amplification on the transmitting frequency band and transmits the amplified signal from the antenna ANT. The amplifying circuit AMPb amplifies a received signal extracted from the duplexer DPX. The bandpass filter BPFb allows only a received frequency band in the received signal output from the amplifying circuit AMPb to pass through it. The amplifying circuit MIXb outputs a receiving intermediate frequency signal IF by mixing a frequency signal output from the synthesizer SYN and the received signal.

As the duplexer DPX in FIG. 5, a duplexer having the structure shown in FIGS. 3A and 3B is used. As the bandpass filters BPFa, BPFb, and BPFc, dielectric filters having the structure shown in FIGS. 1A and 1B, or 2A and 2B, are used.

As described above, by using small, reliable filters and duplexers, a small communication apparatus having good high frequency circuit characteristics is obtained.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A dielectric filter comprising:

a dielectric block having therein resonator holes extending between a first surface of the dielectric block and a second surface opposite to the first surface, the resonator holes being arranged in parallel and having internal conductors formed on internal surfaces of the resonator holes;

external conductors formed on surfaces of the dielectric block, the first surface of the dielectric block being used as an open circuit surface; and a conductive cover for covering the open circuit surface of the dielectric block, wherein said conductive cover has a bent portion which defines a first part and a second part, said first part being placed in contact with one of the external conductors and said second part being arranged parallel to the open circuit surface, and said conductive cover has at least one inwardly projecting portion at a predetermined position along the bent portion.

2. The dielectric filter according to claim 1, wherein the at least one inwardly projecting portion is shaped so as to be in contact with the open circuit surface of the dielectric block and positioned between two predetermined adjacent resonator holes among the resonator holes.

3. The dielectric firer according to claim 1, wherein the at least one inwardly projecting portion is rectangular in cross-section.

4. The dielectric filter according to claim 1, wherein the at least one inwardly projecting portion is triangular in cross-section.

5. The dielectric filter according to claim 1, wherein the at least one inwardly projecting portion is shaped so as to increase the strength of the bent portion.

6. The dielectric filter according to claim 1, wherein the at least one inwardly projecting portion is positioned between two adjacent resonator holes among the resonator holes and is shaped so as to reduce the coupling between the two adjacent resonator holes.

7. The dielectric filter according to claim 1, wherein the at least one inwardly projecting portion is positioned between two adjacent resonator holes among the resonator holes and is shaped so as to not reduce the coupling between the two adjacent resonator holes.

8. The dielectric filter according to claim 1, wherein the first part and the second part of the bent portion are arranged at an angle of approximately 90° relative to each other.

9. A dielectric duplexer comprising:

a dielectric block;

a transmitting filter comprising a first set of resonator holes extending between a first surface of the dielectric block and a second surface opposite to the first surface, the first set of resonator holes having internal conductors formed on internal surfaces thereof;

a receiving filter comprising a second set of resonator holes extending between the first surface of the dielectric block and the second surface opposite to the first surface, the second set of resonator holes having internal conductors formed on internal surfaces thereof;

external conductors formed on surfaces of the dielectric block, the first surface of the dielectric block being an open circuit surface; and a conductive cover covering the open circuit surface of the dielectric block, wherein said conductive cover has a bent portion which defines a first part and a second part, said first part being placed in contact with one of the external conductors and said second part being arranged parallel to the open circuit surface, and said conductive cover has at least one inwardly projecting portion disposed along the bent portion between the transmitting filter and the receiving filter.

10. The dielectric duplexer according to claim 9, wherein the at least one inwardly projecting portion is shaped so as to be in contact with the open circuit surface of the dielectric block.

11. The dielectric duplexer according to claim 9, wherein the at least one inwardly projecting portion is rectangular in cross-section.

12. The dielectric duplexer according to claim 9, wherein the at least one inwardly projecting portion is triangular in cross-section.

13. The dielectric duplexer according to claim 9, wherein the at least one inwardly projecting portion is shaped so as to increase the strength of the bent portion.

14. The dielectric duplexer according to claim 9, wherein the at least one inwardly projecting portion is shaped so as to reduce the coupling between adjacent resonator holes of the transmitting filter and the receiving filter.

15. The dielectric duplexer according to claim 9, wherein the at least one inwardly projecting portion is shaped so as to not reduce the coupling between adjacent resonator holes of the transmitting filter and the receiving filter.

16. The dielectric duplexer according to claim 9, wherein the first part and the second part of the bent portion are arranged at an angle of approximately 90° relative to each other.

17. A conductive cover for covering an open circuit surface of a dielectric filter, the conductive cover comprising:

a metal plate having a bent portion defining a first part and a second part, the second part being arranged at an angle relative to the first part; and at least one inwardly projecting portion at a predetermined position along the bent portion.

18. The dielectric filter according to claim 17, wherein the at least one inwardly projecting portion is rectangular in cross-section.

19. The dielectric filter according to claim 17, wherein the at least one inwardly projecting portion is triangular in cross-section.

20. The dielectric filter according to claim 17, wherein the angle is approximately 90°.

* * * * *